US009897977B2

(12) United States Patent
Klopfenstein et al.

(10) Patent No.: US 9,897,977 B2
(45) Date of Patent: Feb. 20, 2018

(54) ARRANGEMENT OF ELECTRODES FOR A DIGITAL DISPLAY

(71) Applicant: ETA SA MANUFACTURE HORLOGÈRE SUISSE, Grenchen (CH)

(72) Inventors: Francois Klopfenstein, Delemont (CH); Daniel Gruenig, Sugiez (CH); Pascal Lagorgette, Bienne (CH)

(73) Assignee: ETA SA MANUFACTURE HORLOGÈRE SUISSE, Grenchen (CH)

( * ) Notice: Subject to any disclaimer, the term of this patent is extended or adjusted under 35 U.S.C. 154(b) by 18 days.

(21) Appl. No.: 14/540,380

(22) Filed: Nov. 13, 2014

(65) Prior Publication Data

US 2015/0177703 A1 Jun. 25, 2015

(30) Foreign Application Priority Data

Dec. 23, 2013 (EP) ..... 13199307

(51) Int. Cl.
*G04G 9/08* (2006.01)
*G04G 17/04* (2006.01)
(Continued)

(52) U.S. Cl.
CPC ..... *G04G 9/085* (2013.01); *G04G 9/00* (2013.01); *G04G 9/08* (2013.01); *G04G 9/10* (2013.01);
(Continued)

(58) Field of Classification Search
CPC ..... G04G 9/0017; G04G 9/0082; G04G 9/02; G04G 9/08; G04G 9/085; G04G 9/087;
(Continued)

(56) References Cited

U.S. PATENT DOCUMENTS 3,631,459 A * 12/1971 Morris, Jr. ..... B41J 2/34 178/30
3,702,723 A * 11/1972 Borden ..... G02F 1/134327 345/50
(Continued)

FOREIGN PATENT DOCUMENTS

DE 1104902 B * 4/1961 ..... G04C 17/00
DE 3214174 A1 10/1983
(Continued)

OTHER PUBLICATIONS

European Search Report for EP 13 19 9307 dated Jul. 17, 2014.

*Primary Examiner* — Amy Cohen Johnson
*Assistant Examiner* — Daniel Wicklund
(74) *Attorney, Agent, or Firm* — Sughrue Mion, PLLC

(57) ABSTRACT

Arrangement of electrodes for a juxtaposed two digit display including a left digit and a right digit is disclosed. The right digit includes an upper electrode, a median electrode and a lower electrode. The right digit includes a lateral upper left electrode, a lateral lower left electrode, a lateral upper right electrode and a lateral lower right electrode. The left digit includes an upper electrode, a median electrode and a lower electrode. The left digit includes a lateral upper left electrode, a lateral lower left electrode, a lateral upper right electrode and a lateral lower right electrode. In the left digit, the upper electrode, the median electrode and the lower electrode are each formed of a first and second point-shaped electrode. A first additional electrode is provided between the lateral upper left electrode and the lateral upper right electrode of the left digit, the first additional electrode being adjacent to the lateral upper right electrode, and a second additional electrode is provided between the lateral lower left electrode and the lateral lower right electrode, the
(Continued)

second additional electrode being adjacent to the lateral lower right electrode.

14 Claims, 4 Drawing Sheets

(51) Int. Cl.
*G09G 3/04* (2006.01)
*G04G 9/00* (2006.01)
*G04G 9/10* (2006.01)

(52) U.S. Cl.
CPC ..... *G04G 17/045* (2013.01); *G09G 3/04* (2013.01); *G09G 2300/0426* (2013.01)

(58) Field of Classification Search
CPC ..... G04G 9/10; G04G 9/102; G04G 9/105; G04G 9/107; G04G 9/12; G04G 9/122; G04G 9/124; G04G 9/126; G09F 3/04; G09F 9/30; G09F 9/302; G09F 9/3023; G09F 9/35; G09G 2300/0421; G09G 2300/0426; G02F 1/134327
USPC ..... 345/33, 34, 44, 55; 349/142, 143, 146; 368/79, 82–84
See application file for complete search history.

(56) References Cited

U.S. PATENT DOCUMENTS

| | | | | | |
|---|---|---|---|---|---|
| 3,943,881 | A * | 3/1976 | Shiota | G02F 1/134327 | 313/499 |
| 3,971,012 | A * | 7/1976 | Morokawa | G09F 9/302 | 217/65 |
| 4,949,081 | A * | 8/1990 | Keller | G09F 9/302 | 345/33 |
| 5,266,934 | A * | 11/1993 | Van Almen | G09F 9/302 | 345/50 |
| 5,497,171 | A * | 3/1996 | Teres | G09F 9/302 | 345/33 |
| 6,760,987 | B1 * | 7/2004 | Mulkey | G09F 9/302 | 40/450 |
| 2001/0002637 | A1 | 6/2001 | Hani et al. | | |
| 2009/0109802 | A1 * | 4/2009 | Buss | G04G 9/12 | 368/82 |

FOREIGN PATENT DOCUMENTS

| | | | | |
|---|---|---|---|---|
| EP | 0 421 517 | A1 | 4/1991 | |
| GB | 2 071 386 | A | 9/1981 | |
| WO | WO 2008099153 | A1 * | 8/2008 | G09F 9/302 |

* cited by examiner

ARRANGEMENT OF ELECTRODES FOR A DIGITAL DISPLAY

This application claims priority from European Patent Application No. 13199307.3 filed Dec. 23, 2013 the entire disclosure of which is incorporated herein by reference.

FIELD OF THE INVENTION

This invention concerns the arrangement of electrodes for a digital display. More specifically, this invention concerns the arrangement of electrodes for a digital display for the date on a timepiece.

BACKGROUND OF THE INVENTION

For a timepiece such as a wrist watch that displays the time by means of an hour hand and a minute hand which move above a dial, the date is generally displayed by means of a disc, known as the date-disc, to which the date indications are affixed and which is driven by the timepiece movement. The date indications are typically displayed through an aperture on the dial of the watch. Rather than displaying the date by means of a rotating disc on which the 31 dates are printed, it has also already been proposed to display the date digitally by means of a digital data display device, such a liquid crystal cell, visible through an aperture. In this case, the date indications comprised between 1 and 31 are successively displayed by means of two juxtaposed groups of seven segments that are commonly known as seven segment digits. The right hand digit is usually used to display the units of the date, and the left hand digit to display the tens of the date. This poses a problem for the dates from 1 to 9 that only have one figure. Indeed, in this case, only the right hand digit is used to display the date, so that the date appears off centre in the aperture in which it is displayed. Seven segment digits or groups provide a display that is now often considered as outdated and unattractive.

SUMMARY OF THE INVENTION

It is an object of the present invention to overcome the aforementioned drawbacks in addition to others by providing a new arrangement of electrodes making it possible, in particular, to obtain a centred display of a single figure number.

To this end, the present invention concerns an arrangement of electrodes for a juxtaposed two digit display, the display comprising a left digit and a right digit, the right digit comprising an upper electrode, a median electrode and a lower electrode, the median electrode extending between the upper electrode and the lower electrode, the right digit also comprising a lateral upper left electrode and a lateral lower left electrode, as well as a lateral upper right electrode and a lateral lower right electrode, the left digit comprising an upper electrode, a median electrode and a lower electrode, the median electrode extending between the upper electrode and the lower electrode, the left digit also comprising a lateral upper left electrode and a lateral lower left electrode, as well as a lateral upper right electrode and a lateral lower right electrode, the arrangement of the electrodes being characterized in that, in the left digit, the upper electrode, the median electrode and the lower electrode are each formed of a first and second point-shaped electrodes, and in that a first additional electrode is provided between the lateral upper left electrode and the lateral upper right electrode of the left digit, the first additional electrode being adjacent to the lateral upper right electrode, whilst a second additional electrode is provided between the lateral lower left electrode and the lateral lower right electrode, the second additional electrode being adjacent to the lateral lower right electrode, According to a complementary characteristic of the invention, the second point-shaped electrodes of the upper electrode, of the median electrode and of the lower electrode and the additional electrode are vertically aligned.

According to a further characteristic of the invention, an additional electrode is provided between the lateral upper left electrode and the lateral upper right electrode of the right digit, at an equal distance from the two electrodes.

According to another characteristic of the invention, three point-shaped electrodes are arranged one above the other between the left digit and the right digit, respectively at the height of the upper electrode, of the median electrode and of the lower electrode of the right digit.

According to another characteristic of the invention, a point-shaped electrode is provided in both the left and right digits, respectively at the intersection between each of the upper, central and lower electrodes and each of the lateral upper left, lateral lower left, lateral upper right and lateral lower right electrodes.

According to another characteristic of the invention, the upper electrode, median electrode and lower electrode of the left digit and of the right digit extend horizontally and remote from each other.

According to another characteristic of the invention, the lateral upper left electrode and the lateral lower left electrode, and respectively the lateral upper right electrode and the lateral lower right electrode of each of the two digits extend vertically in the extension of each other.

As a result of these characteristics, this invention offers a display formed of two juxtaposed groups of segments commonly called digits, which, in particular, make it possible to display the figures 0 to 9 in a centred manner with regard to these two digits. The arrangement of the electrodes according to the invention also makes it possible to display the figures in a more precise and attractive manner. In addition, in its preferred embodiment, the electrode arrangement comprises a total of 39 segments. This is more than two digits of seven segments each, but far less than a matrix display, thus making it possible to continue to use a non-multiplexed addressing technology which offers advantages in terms of display contrast and production costs. In addition to the numbers 0 to 9, the electrode arrangement according to the invention also makes it possible to display certain letters such as "M", which is useful for displaying the indications "AM" and "PM" when setting an alarm or the initial time and date setting. The left digit also makes it possible to display the letter "Y", which is useful for the initial setting of the year for a perpetual calendar function.

BRIEF DESCRIPTION OF THE DRAWINGS

Other features and advantages of the present invention will appear more clearly from the following detailed description of one embodiment of the arrangement of electrodes according to the invention, this example being given merely by way of non-limiting illustration with reference to the annexed drawing, in which.

DETAILED DESCRIPTION OF AN EMBODIMENT OF THE INVENTION

The present invention proceeds from the general inventive idea which consists of rethinking the arrangement of electrodes for a display of two juxtaposed digits, making it possible, on the one hand, to display the numbers formed of a single figure from 0 to 9 in a centred manner with respect to the two electrodes groups and, on the other hand, to display the figures in a more realistic and attractive manner. This result is achieved as a result of the fact that the proposed electrode arrangement is asymmetrical, the left digit not being arranged in the same manner as the right digit. In this respect, the present invention goes against common sense, according to which the two digits should have the same structure given that they are both used to display the same numbers. In a simplified embodiment of the invention, only the left digit is substantially modified, the right digit remaining a conventional seven segment digit to which only one additional electrode is added. This facilitates the structuring of the electrodes and makes it possible to leave unchanged the addressing of the electrodes of the right digit.

Figure 1:
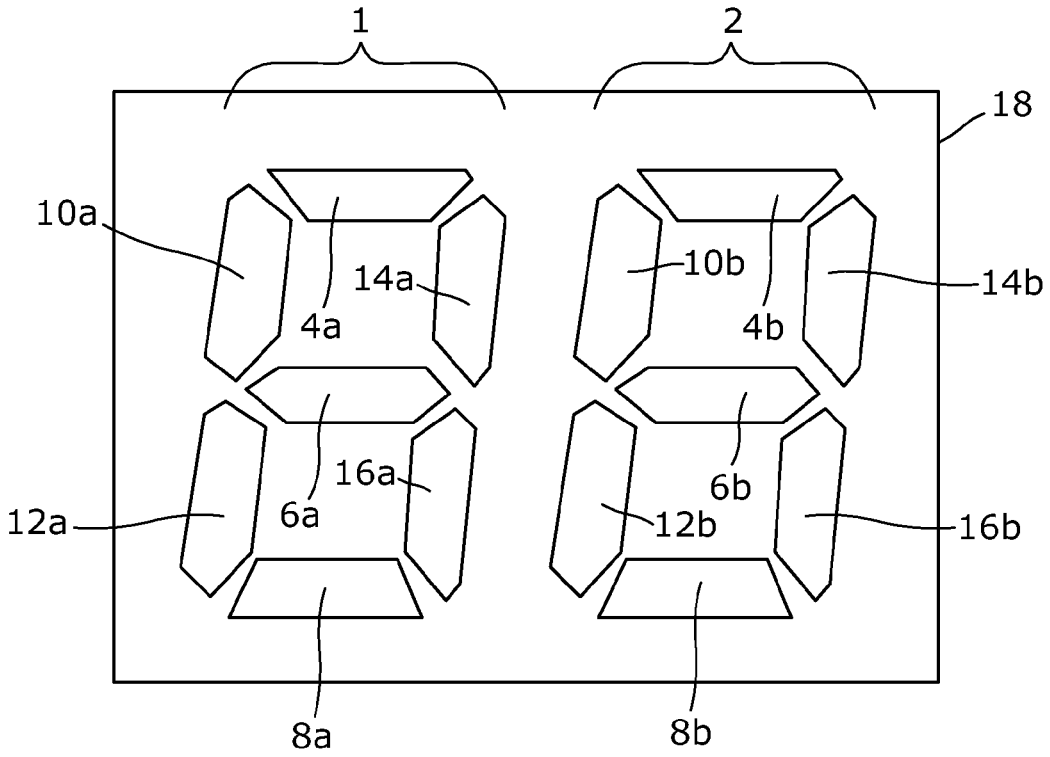
Fig. 1 Prior Art
FIG. 1 shows a display formed of two juxtaposed groups of seven segments according to the prior art.

FIG. 1 illustrates an electrode arrangement of the prior art for a display formed by two juxtaposed groups of electrodes, these two groups of electrodes being commonly called digits. It can be seen that the left digit, designated as a whole by the general reference number 1, and the right digit, designated as a whole by the general reference number 2, are arranged in the same manner. More specifically, each of the left digit 1 and right digit 2, comprises an upper electrode 4*a*, 4*b*, a median electrode 6*a*, 6*b* and a lower electrode 8*a*, 8*b*, the median electrode 6*a*, 6*b* extending between the upper electrode 4*a*, 4*b* and the lower electrode 8*a*, 8*b*. The left and right digits 1, 2 also comprise a lateral upper left electrode 10*a*, 10*b* and a lateral lower left electrode 12*a*, 12*b*, as well as a lateral upper right electrode 14*a*, 14*b* and a lateral lower right electrode 16*a*, 16*b*.

The arrangement of electrodes according to the prior art discussed above allows any number between 0 and 99 to be displayed by activating the appropriate combination of electrodes. Such an arrangement is, however, considered by many users to be rather outdated and unattractive. Especially, when only one figure, from 0 to 9, is required to be displayed, only one of the two digits is activated, generally the digit on the right. The display of a single figure is therefore off centre in relation to the group of two digits, which is unsatisfactory, in particular where this display appears through an aperture 18 arranged, for example, in a watch dial for indicating the current date or the like.

To overcome this problem, the present invention teaches a new arrangement of electrodes for a display formed of two juxtaposed groups of electrodes, these two groups of electrodes being commonly called digits. It is noted that only the left digit, designated as a whole by the general reference number 20, is substantially modified in comparison to the prior art, whilst the right digit, designated as a whole by the general reference number 22, retains a structure quite similar to that of a conventional seven segment digit as described above in relation to the prior art.

More specifically, the left digit 20 comprises an upper electrode 24, a median electrode 26 and a lower electrode 28, the median electrode 26 extending between the upper electrode 24 and the lower electrode 28. Preferably, the upper electrode 24, the median electrode 26 and the lower electrode 28 extend horizontally and remote from each other. The left digit 20 also comprises a lateral upper left electrode 30*a* and a lateral lower left electrode 32*a*, as well as a lateral upper right electrode 30*b* and a lateral lower right electrode 32*b*. Preferably, the lateral upper left electrode 30*a* and the lateral lower left electrode 32*a*, and respectively the lateral upper right electrode 30*b* and the lateral lower right electrode 32*b* extend vertically in the extension of each other.

According to the invention, in left digit 20, the upper electrode 24, median electrode 26 and lower electrode 28 are each formed by a first and second point-shaped electrode respectively 24*a*, 24*b*, 26*a*, 26*b*, and 28*a*, 28*b*. Moreover, a first additional electrode 34 is provided between lateral upper left electrode 30*a* and lateral upper right electrode 30*b*. Advantageously, first additional electrode 34 is adjacent to lateral upper right electrode 30*b*. Moreover, a second additional electrode 35 is provided between lateral lower left electrode 32*a* and lateral lower right electrode 32*b*. Advantageously, the second additional electrode 35 is adjacent to lateral lower right electrode 32*b*. This electrode arrangement is particularly useful for displaying the letter "Y", which is required for the initial setting of the year for a perpetual calendar function.

Also, the right digit 22 comprises an upper electrode 36, a median electrode 38 and a lower electrode 40, the median electrode 38 extending between the upper electrode 36 and the lower electrode 40. Preferably, the upper electrode 36, the median electrode 38 and the lower electrode 40 extend horizontally and remote from each other. The right digit 22 also comprises a lateral upper left electrode 42*a* and a lateral lower left electrode 44*a*, as well as a lateral upper right electrode 42*b* and a lateral lower right electrode 44*b*. Preferably, the lateral upper left electrode 42*a* and the lateral lower left electrode 44*a*, and respectively the lateral upper right electrode 42*b* and the lateral lower right electrode 44*b* extend vertically in the extension of each other.

According to a further characteristic of the invention, an additional electrode 46 is provided between the lateral upper left electrode 42*a* and the lateral upper right electrode 42*b* of right digit 22, at an equal distance from the two electrodes 42*a*, 42*b*. This additional electrode 46 serves in particular for displaying the letter "M" which is particularly useful for displaying the indications "AM" and "PM" when setting an alarm or for the initial setting of the time and date.

It will also be understood that the existence of the additional electrodes 34, 35, off set to the left relative to right digit 22, in combination with the electrodes for right digit 22, makes it possible to display the numbers formed of a single figure 0 to 9 in a centred manner with regard to the group of two digits 20 and 22, which is very useful in the event that this display appears through an aperture 48 arranged, for example, in a watch dial for indicating the date or the like.

According to another characteristic of the invention, three point-shaped electrodes 50*a*, 50*b* and 50*c* are arranged one above the other between left digit 20 and right digit 22, respectively at the height of the upper electrode 36, of the median electrode 38 and of the lower electrode 40 of right digit 22.

According to another characteristic of the invention, point-shaped electrodes designated by the references a to 1 are arranged in both the left and right digits 20, 22, respectively at the intersection between each of the upper electrodes 24, 36, median electrodes 26, 38 and lower electrodes 28, 40 and each of the lateral upper left electrodes 30*a*, 42*a*, lateral lower left electrodes 32*a*, 44*a*, lateral upper right electrodes 30*b*, 42*b* and lateral lower right electrodes 32*b*, 44*b*.

Finally, four indicators 52, for example of a triangular shape, provided to the left and right make it possible to point to indications affixed to the dial around the aperture 48, to the exterior of left and right digits 20, 22. These four indicators 52 are respectively adjacent to the lateral upper left electrode 30*a* and the lateral lower left electrode 32*a* of left digit 20, and with lateral upper right electrode 42*b* and lateral lower right electrode 44*b* of right digit 22. This makes it possible to add a large number of additional functions such as the setting and display of the state of an alarm, indicators 52 pointing for example to "ON" and "OFF" markings on the dial. To further improve the legibility of indicators 52, these indicators 52 can be displayed with the corresponding lateral electrode.

In its preferred embodiment, the electrode arrangement according to the invention comprises a total of 39 segments. This is more than two digits of seven segments each, but far less than a matrix display, thus making it possible to continue to use a non-multiplexed addressing technology that offers advantages in terms of display contrast and production costs.

Figure 2:
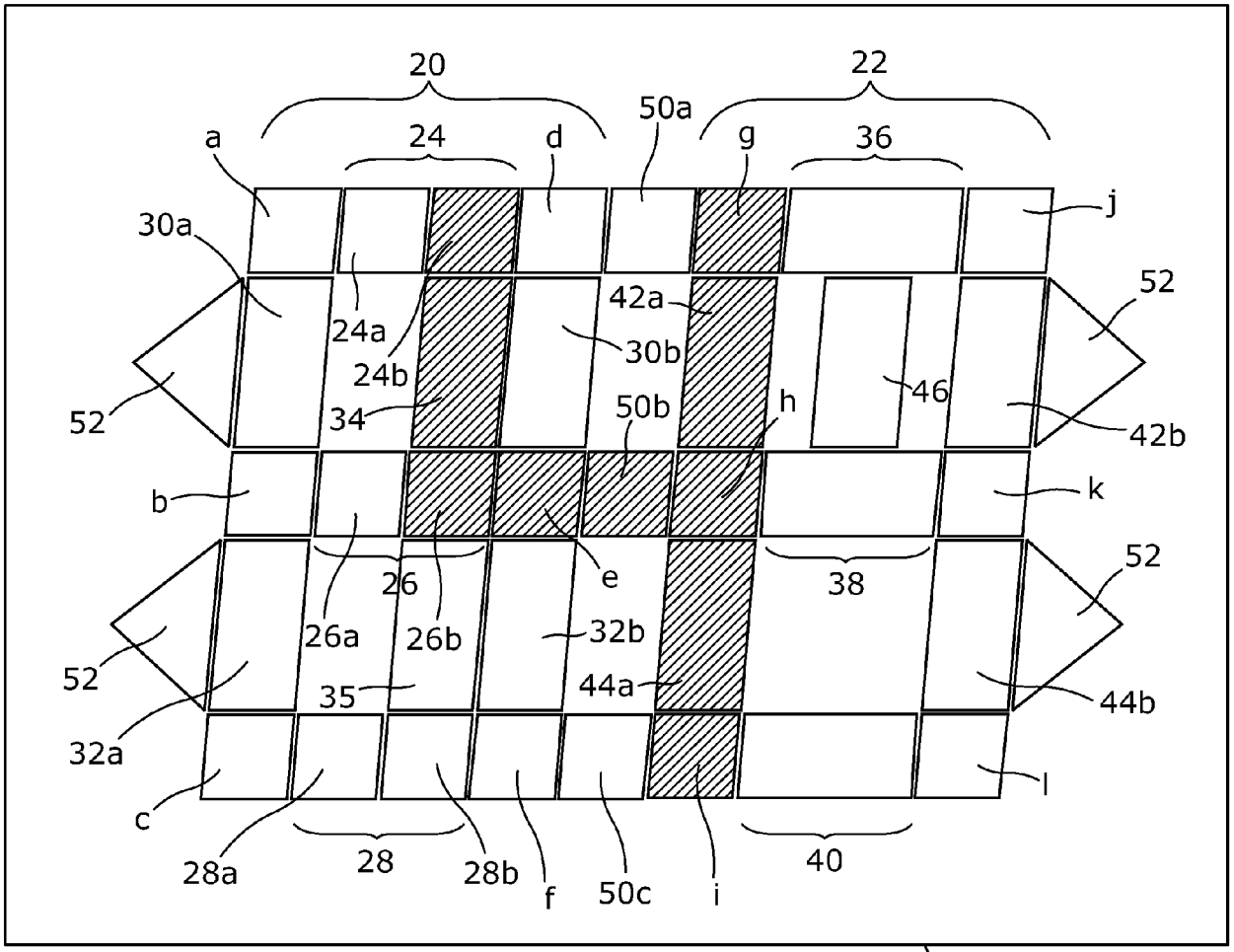
FIG. 2 shows a display formed of two juxtaposed groups of segments according to the invention.

By way of example, the electrodes that must be activated to display the number 4 are shown shaded in FIG. 2.

Figure 3:
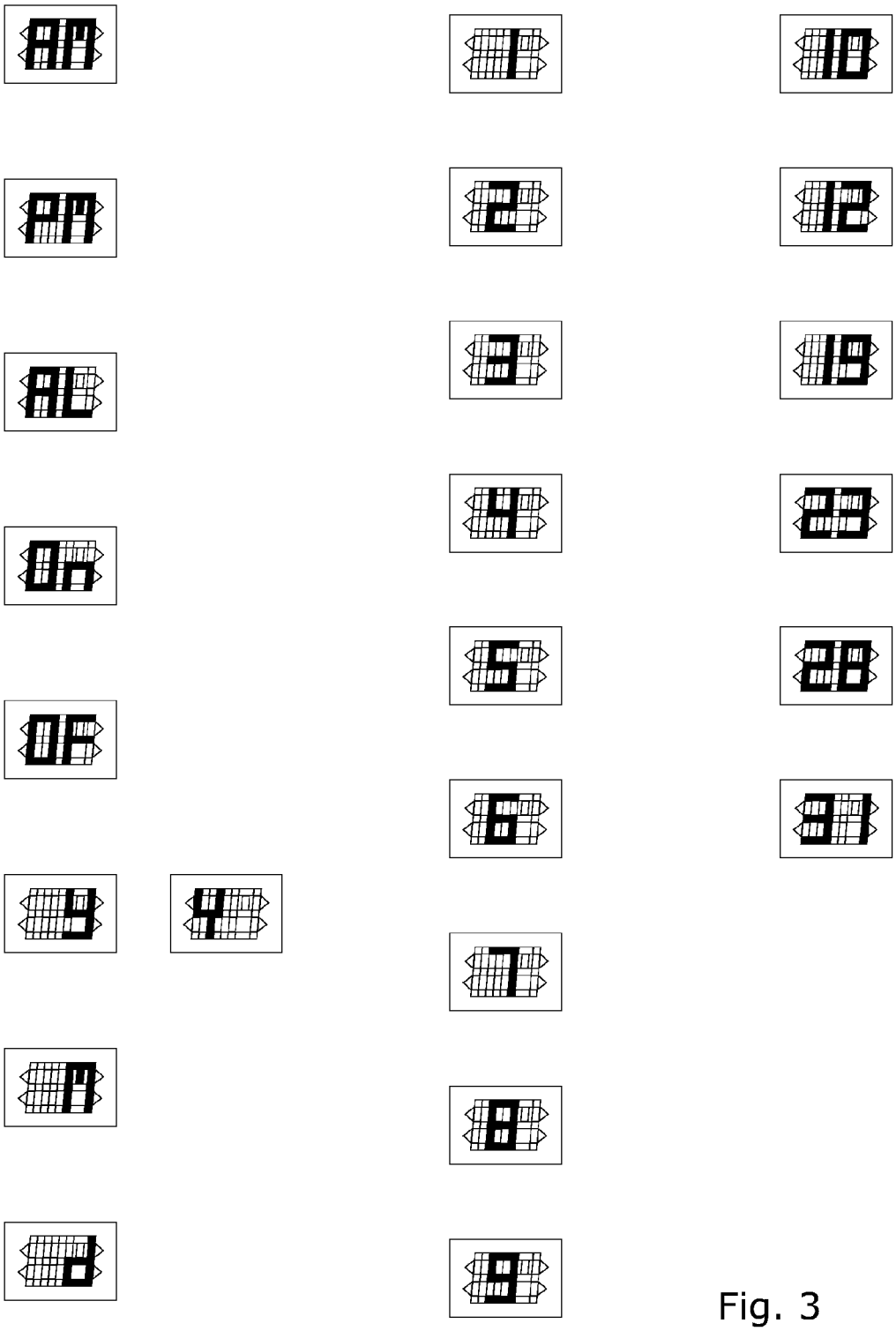
FIG. 3 shows different alphanumerical indications that can be displayed by means of the display in FIG. 2.
Figure 4:
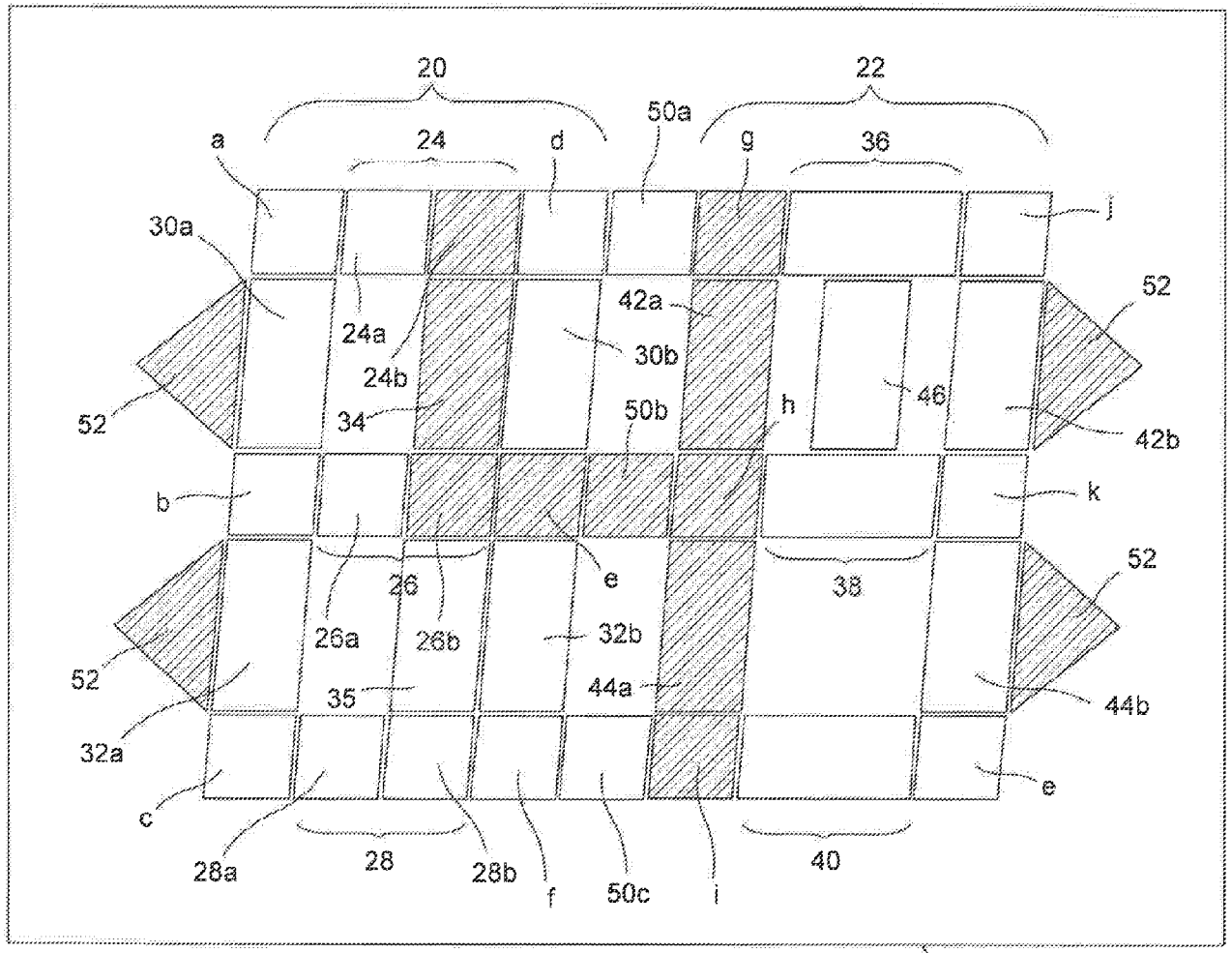
FIG. 4 shows the display with indicators in activated states.

FIG. 3 shows various alphanumerical indications that can be displayed by means of the display of FIG. 2. Alphabetical indications such as "AM", "PM", "AL", "On", "OF", "Y", "M", "d" are illustrated in the column on the left. The date indications from "1" to "9" are illustrated in the central column, that is to say the date indications comprising a single digit. It is noted that, according to a determining advantage of the invention, these single digit date indications are centred in relation to the group of two digits. Finally, the column on the right illustrates the display of a few two digit date indications.

It goes without saying that this invention is not limited to the embodiment that has just been described and that various simple modifications and variants can be envisaged by those skilled in the art without departing from the scope of the invention as defined by the annexed claims.

What is claimed is:

1. An arrangement of electrodes for a juxtaposed two digit display, wherein the two digit display comprises a left digit and a right digit, wherein the right digit comprises an upper electrode, a median electrode and a lower electrode, wherein the median electrode extends between the upper electrode and the lower electrode, wherein the right digit also comprises a lateral upper left electrode and a lateral lower left electrode, and a lateral upper right electrode and a lateral lower right electrode, wherein the left digit comprises an upper electrode, a median electrode and a lower electrode, wherein the median electrode extends between the upper electrode and the lower electrode of the left digit, wherein the left digit also comprises a lateral upper left electrode and a lateral lower left electrode, as well as a lateral upper right electrode and a lateral lower right electrode, wherein, in the left digit, the upper electrode, the median electrode and the lower electrode are each formed of a first and second point-shaped electrode, and wherein a first additional electrode is provided between the lateral upper left electrode and the lateral upper right electrode of the left digit, wherein the first additional electrode is adjacent to the lateral upper right electrode of the left digit such that an asymmetrical arrangement of the electrodes is formed by the first additional electrode and the lateral upper right electrode of the left digit, and a second additional electrode is provided between the lateral lower left electrode and the lateral lower right electrode of the left digit, wherein the second additional electrode is adjacent to the lateral lower right electrode of the left digit such that an asymmetrical arrangement of the electrodes is formed by the second additional electrode and the lateral lower right electrode of the left digit, and wherein a portion of the asymmetrically arranged electrodes of the left digit and a portion of the electrodes from the right digit are configured to display a single digit in a center of the two digit display.

2. The electrode arrangement according to claim 1, wherein the second point-shaped electrodes of the left digit upper electrode, of the left digit median electrode and of the left digit lower electrode and the first and second additional electrodes of the left digit are vertically aligned.

3. The electrode arrangement according to claim 2, wherein an additional electrode is provided between the lateral upper left electrode and the lateral upper right electrode of the right digit, at an equal distance from said lateral upper left electrode and lateral upper right electrode of the right digit.

4. The electrode arrangement according to claim 3, wherein three point-shaped electrodes are arranged one above the other between the left digit and the right digit, respectively at the height of the upper electrode, of the median electrode and of the lower electrode of the right digit.

5. The electrode arrangement according to claim 2, wherein three point-shaped electrodes are arranged one above the other between the left digit and the right digit, respectively at the height of the upper electrode, of the median electrode and of the lower electrode of the right digit.

6. The electrode arrangement according to claim 1, wherein an additional electrode is provided between the lateral upper left electrode and the lateral upper right electrode of the right digit, at an equal distance from said lateral upper left electrode and lateral upper right electrode of the right digit.

7. The electrode arrangement according to claim 6, wherein three point-shaped electrodes are arranged one above the other between the left digit and the right digit, respectively at the height of the upper electrode, of the median electrode and of the lower electrode of the right digit.

8. The electrode arrangement according to claim 1, wherein three point-shaped electrodes are arranged one above the other between the left digit and the right digit, respectively at the height of the upper electrode, of the median electrode and of the lower electrode of the right digit.

9. The electrode arrangement according to claim 1, wherein point-shaped electrodes are provided in both the left and right digits, respectively at the intersection between each of the upper electrodes, median electrodes and lower electrodes and each of the lateral upper left electrodes, lateral lower left electrodes, lateral upper right electrodes and lateral lower right electrodes of the two left and right digits.

10. The electrode arrangement according to claim 1, wherein the upper electrode, median electrode and lower electrode of the left digit and of the right digit extend horizontally and remote from each other.

11. The electrode arrangement according to claim 1, wherein the lateral upper left electrode and the lateral lower left electrode, and respectively the lateral upper right electrode and the lateral lower right electrode of each of the left and right digits extend vertically in the extension of each other.

12. The electrode arrangement according to claim 1, wherein four indicators pointing to the exterior of the left and right digits are respectively associated with the lateral upper left electrode and the lateral lower left electrode of the left digit, and with the lateral upper right electrode and the lateral lower right electrode of the right digit.

13. The electrode arrangement according to claim 1, wherein a small gap is formed between the first additional electrode and the lateral upper right electrode of the left digit, and a gap, being larger than the small gap, is formed between the lateral upper right electrode of the left digit and the lateral upper left electrode of the right digit.

14. The electrode arrangement according to claim 1, wherein a small gap is formed between the second additional electrode and the lateral lower right electrode of the left digit, and a gap, being larger than the small gap, is formed between the lateral lower right electrode of the left digit and the lateral lower left electrode of the right digit.

* * * * *